US007287459B2

(12) United States Patent
Tabata et al.

(10) Patent No.: US 7,287,459 B2
(45) Date of Patent: Oct. 30, 2007

(54) PISTON FOR INTERNAL COMBUSTION ENGINE

(75) Inventors: Masamune Tabata, Saitama (JP); Naoko Sato, Saitama (JP); Takashi Shiraishi, Saitama (JP); Yasunori Murakami, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/287,247

(22) Filed: Nov. 28, 2005

(65) Prior Publication Data

US 2006/0117947 A1 Jun. 8, 2006

(30) Foreign Application Priority Data

Dec. 2, 2004 (JP) ..... 2004-349689

(51) Int. Cl.
*F02F 3/10* (2006.01)
*F02F 3/22* (2006.01)
*F01B 31/10* (2006.01)

(52) U.S. Cl. ..... 92/159; 92/223

(58) Field of Classification Search ..... 92/158, 92/159, 223; 123/193.4, 193.6; 29/888.048
See application file for complete search history.

(56) References Cited

U.S. PATENT DOCUMENTS 1,016,561 A * 2/1912 Grabler ..... 92/158
2,817,562 A * 12/1957 Fleming et al. ..... 92/155
4,760,771 A * 8/1988 Felici et al. ..... 92/159
4,987,865 A * 1/1991 Schenkel ..... 92/223
5,314,717 A * 5/1994 Alt ..... 92/223
5,884,600 A * 3/1999 Wang et al. ..... 92/223
6,817,333 B2 * 11/2004 Wang et al. ..... 123/193.6
2005/0087166 A1 * 4/2005 Rein et al. ..... 29/888.048

FOREIGN PATENT DOCUMENTS

| | | |
|---|---|---|
| JP | 52-16451 U | 2/1977 |
| JP | 57-193941 U | 12/1982 |
| JP | 2004-149622 | 5/2004 |
| JP | 2005-320934 | 11/2005 |
| WO | 01/02712 A1 | 1/2001 |
| WO | 01/02717 A1 | 1/2001 |

* cited by examiner

*Primary Examiner*—Thomas E. Lazo
(74) *Attorney, Agent, or Firm*—Arent Fox LLP

(57) ABSTRACT

A piston for an internal combustion engine, the piston having a skirt part, comprises: a resinous coating layer formed on a surface of the skirt part; and a plurality of concaves regularly arranged in the resinous coating layer. The concaves are non-coated regions in which said resinous coating layer is not formed.

22 Claims, 4 Drawing Sheets

PISTON FOR INTERNAL COMBUSTION ENGINE

BACKGROUND OF THE INVENTION

1. Field of the Invention

Priority is claimed on Japanese Patent Application No. 2004-349689, filed Dec. 2, 2004, the content of which is incorporated herein by reference.

The present invention relates to a piston for an internal combustion engine, more specifically to a technique for forming a resinous coating layer on a skirt part surface so as to reduce a frictional resistance of the piston.

2. Description of Related Art

It has been known that surface treatment of a sliding surface of a piston of an internal combustion engine improves fuel efficiency and prevents seizure and abnormal noise generation. For example, a surface treatment has been proposed in which minute concaves are provided on a skirt part outer wall by sand blasting or shot peening (e.g. cf. Patent Reference 1). Patent Reference 1 proposes that lubrication oil is retained in those minute concaves to hardly flow down such that seizure of the cylinder liner and piston can be prevented.

As a similar surface treatment to that of Patent Reference 1, a piston for a 2-stroke cycle gasoline engine with a number of concaves molded by pressurized molding processing, sand blasting, shot peening, and so on, in an outer circumferential surface of the skirt part (e.g., cf. Patent Reference 2), has been proposed. Patent Reference 2 proposes that since, by providing concaves on the skirt part of the piston, sufficient lubricating oil is supplied to the upper portion of the cylinder inner wall surface exposed to the high temperature gas, lubrication performance is improved over the entire sliding surface between the piston and cylinder.

There has been also disclosed a piston in which a protruding part extending along the circumferential direction is provided on the skirt part of the side surface of the piston body and further minute dimples (concaves) are provided on the surface of this protruding part (e.g. cf. Patent Reference 3). These minute dimples are formed in the appropriate size by shot peening. According to Patent Reference 3, the lubricating oil is not only retained in respective minute dimples but also is easily supplied from coves part formed on concaves to the sliding surface. Accordingly, after a primary abrasion is finished and the piston adapts itself to the sleeve, the lubricating oil is supplied to the sliding surface to form an oil film so as to enable not only the lubrication of the sliding surface but also prevention of abnormal noise generation.

Further, there has been disclosed a sliding part element on which a coating layer is formed after streaks are formed on the surface of basic material for the sliding part element such that the surface roughness thereof becomes 8 μm Rz to 18 μm Rz by the 10 point average roughness measuring (e.g. cf. Patent Reference 4). Specifically, the coating layer is composed of a dry coating film lubricant containing at least one type of coating film modifier selected from polyamide-imide resin, epoxy silane and epoxy resin and at least one type of hard particle selected from silicone nitride and alumina. According to Patent Reference 4, since an abrasion resistance and close contact of the sliding part element are improved while a friction coefficient of the sliding part element is reduced by the aforementioned coating layer, an invention of Patent Reference 4 can be applied to pistons.

[Patent Reference 1] Japanese Utility Model Patent Laid-Open Publication No. S 52-16451.

[Patent Reference 2] Japanese Utility Model Patent Laid-Open Publication No. S 57-193941.

[Patent Reference 3] International Patent Laid-Open Pamphlet No. 01/002717.

[Patent Reference 4] Japanese Patent Laid-Open Publication No. 2004-149622.

As described above, in Patent References 1 through 3, minute concaves are provided on the sliding surface of the skirt part made of metal by mechanical processing such as sand blasting, shot peening and pressurized molding to be used as an oil reservoir from which oil is lubricated to the sliding surface so as to reduce the friction of the skirt part. However, in the sliding region of the skirt part in a poor oil lubrication state, what is called the solid contacting region, the effect of reduction of the friction is not achieved by the lubrication oil. Therefore, the surface treatment according to Patent References 1 through 3 was limited to reduction of the frictional resistance at the skirt part.

In Patent Reference 4, a frictional resistance in the solid contact region is reduced by coating the skirt part with a dry coating film lubricant. On the sliding surface of the skirt part, regularly arranged streaks are formed by cutting processing before the coating and serve as the oil reservoir to expand the oil-circulating region, what is called the complex lubrication region in the skirt part so as to reduce the frictional resistance. However, Patent Reference 4, when forming the coating layer, finishes the sliding surface of the basic material to a desired surface roughness in advance by the usual mechanical processes such as grinding and lathing, further forms regularly arranged streaks by cutting process, subsequently applies the coating layer, cures it by the reaction at high temperature so as to form the coating layer with the dry coating film lubricant. That is, although Patent Reference 4, compared to Patent References 1 to 3, is expected to be more effective in reducing the friction resistance of the skirt part, it includes two processes, mechanical and chemical (coating) surface treatments, in the surface treatment of the skirt part. Therefore, there has been a strong demand for a surface treatment method enabling the reduction of frictional resistance of the skirt part more easily.

SUMMARY OF THE INVENTION

The present invention has been made in view of the above-described problems, and its objective is to provide a piston for the internal combustion engine capable of simplifying surface treatment processes to reduce the frictional resistance of the skirt part and at the same time lowering the frictional resistance at both of the solid contact region in a poor oil lubrication state and the oil-circulating complex lubrication region.

The present inventors have actively pursued studies in the hope of solving the above-described problems. As a result, they found out that the above problems can be solved by forming a resinous coating layer on the surface of the skirt part and further providing the regularly arranged concaves on this resinous coating layer so as to reduce the frictional resistance in the solid contact region, achieving this invention. More specifically, this invention provides the following.

(1) A piston for an internal combustion engine, the piston having a skirt part, comprising:

a resinous coating layer formed on a surface of the skirt part; and a plurality of concaves regularly arranged in the resinous coating layer.

The piston according to the invention (1) is to be used in the internal combustion engine having a resinous coating layer formed on the surface of the skirt part. The resinous coating layer may be provided with a number of regularly arranged concaves.

The internal combustion engine may be a 2-stroke cycle gasoline engine or a 4-stroke cycle gasoline engine. Each piston of the internal combustion engine is usually supported by three pieces of piston ring, reciprocating within the cylinder. In general, a piston body made of aluminum alloy is cylindrically formed and composed of a land part and a skirt part. The land part has a top surface to retain piston rings. Of the piston body, an outer circumferential surface of the skirt part (also referred to as sleeve) has the largest area in contact with a cylinder inner wall while sliding.

Therefore, the surface of skirt part may cover the outer circumferential surface of the skirt part and a part in contact with the cylinder inner wall while sliding. Formation of a resinous coating layer on the surface of the skirt part may be resinous coating layer formation over the entire outer circumferential surface area of the skirt part or that on the circumferential surface of the skirt part, other than a periphery of a pin opening for inserting a pin connecting a cylinder and a connecting rod. This is because usually the periphery of the pin opening becomes a side wall formed by cutting off the outer circumferential surface of the skirt part. And, as the occasion may demand, the area range and position of the resinous coating layer may be limited.

On the surface of the skirt part, the piston according to the invention (1) may form a resinous coating layer of a single resin having a low frictional resistance and a high thermostability or that of a composite resin comprising the above-described single resin containing a solid lubricant so as to enable to reduce the frictional resistance of the solid contact region of the skirt part. Either single resin or composite resin may be appropriately selected.

The piston according to the invention (1) is further provided with a plurality of regularly arranged concaves in the resinous coating layer. For example, concaves can be formed on the skirt part by a usual method disclosed in Patent Reference 4. Briefly speaking, the piston body is degreased, rinsed, previously heated and applied with a paint which will become a resinous coating layer to the sliding surface of the skirt part by a spray coating or screen process printing technique. Subsequently, this paint is cured by the high temperature reaction to form the resinous coating layer.

Therefore, when the concaves are masked on the surface of skirt part in advance, they are formed by spray coating. Alternatively, when the concaves are traced on the screen plate as a resist, they can be formed by screen process printing. The concaves may be also referred to as a region surrounded by the resinous coating layer. In addition, the concaves may be surrounded by the resinous coating layer and the resinous coating layer may be formed also on the base of the concaves, or concaves are regularly arranged on the skirt part surface and the resinous coating layer may be formed on the surface including the skirt part concaves. However, at the base of the concaves surrounded by the resinous coating layer, the skirt part surface is preferably exposed.

Concaves of this invention can be regarded as those expressed on the skirt part surface as a predetermined area and substantially surrounded by the resinous coating layer to have a predetermined volume. Shapes of concaves surrounded by the resinous coating layer and expressed on the skirt part surface may be, for example, circular or elliptic, square or rectangular, triangular, or any other shapes comprising closed regions. Further, this invention does not necessarily exclude the presence of different shapes of concaves, but the concaves are preferably of the same shape.

Since the regular arrangement of concaves in the resinous coating layer is an embodiment of the suitable arrangement and the dotted presence thereof in disorder in the resinous coating layer is thought not preferable in view of the function of concaves described below, they are preferably arranged in regularity like a pattern in the resinous coating layer.

Specifically, concaves formed in circular or rectangular shape are probably arranged in a lattice pattern. The lattice pattern in this case may be rectangular or rhombic. Concaves formed in circular or rectangular shape may be arranged at equal intervals in the sliding direction of the skirt part and the circumferential direction perpendicular thereto respectively, and also at different intervals in the sliding direction of the skirt part and the aforementioned circumferential direction.

As described above, concaves according to the present invention have a certain volume and are conferred with an oil retaining function. A plurality of concaves of this invention may function as what is called an oil reservoir so as to reduce the frictional resistance of the complex lubrication region of the skirt part. Further, this invention can reduce the frictional resistance of the complex lubrication region only by a chemical coating treatment without applying a conventional mechanical surface treatment so as to reduce the frictional resistance of the skirt part as a whole.

(2) The piston according to (1), wherein said concaves are non-coated regions in which said resinous coating layer is not formed.

As described above, concaves can be formed by masking or resist. Contrary to the above described concaves whose bottom surfaces may be a resinous coating layer, the bottom of this concave is to be the skirt part surface. That is, the resinous coating layer according to the invention (1) can be formed in multiple layers, while that according to the invention (2) can be formed in a single layer so as to simplify the coating process.

(3) The piston according to (1) or (2) wherein when a length of said concaves in a sliding direction of said skirt part is "S," and a length of said concaves in a circumferential direction perpendicular to said sliding direction is "L," the lengths are set in relationship of "S"="L" or "S"<"L."

In the piston according to the invention (3), when the length of the concaves in the sliding direction of the skirt part is "S" and that in the circumferential direction perpendicular to the sliding direction is "L," concaves are set up in relationship of "S"="L" or "S"<"L."

As a result of actively pursued experiments, the present inventors have confirmed that it is effective for concaves to be set up in relationship of either "S"="L" or "S"<"L." When concaves are set up in relationship of "S">"L," it becomes difficult to secure a sufficient oil pressure at the concaves when the skirt part is sliding such that the oil film is hardly formed on the sliding surface of the skirt part resulting in difficulty to be effective in reducing the frictional resistance in the complex lubrication region.

The shape of concaves set up in relationship of "S"="L" is circle or square. When the shape of concaves set up in relationship of "S"<"L" is elliptic, by arranging the major axis forming the ellipse parallel to the outer circumferential direction of the skirt part and the minor axis of the ellipse perpendicular to the major axis parallel to the sliding direction of the skirt part, the oil pressure is secured in the concaves so as to be effective in reducing the frictional resistance in the complex lubrication region of the skirt part.

(4) The piston according to (3) in which the "S" and "L" are not less than 5 μm and not more than 4 mm.

In the piston according to the invention (4), the length "S" of the concaves in the sliding direction of the skirt part and the length "L" of the concaves in the circumferential direction of the skirt part are set up in the range from 5 μm to 4 mm.

For example, when the shape of concaves is circle and the diameter of the circular concave is not more than 5 μm, the oil hardly flows into the minute concaves due to its own intrinsic viscosity, leading to the reduction of the oil retaining function at the concaves and difficulty to be effective in reducing the friction in the complex lubrication region.

On the other hand, when the diameter of the aforementioned circular concaves is not less than 4 mm, the oil retained in the concaves flows out due to surface pressure such that the oil film is hardly formed on the surface of resinous coating layer. Accordingly, it hardly becomes effective in reducing the friction in the complex lubrication region.

(5) The piston according to any one of (1) through (4) in which wherein a depth of said concaves is not less than 5 μm and not more than 30 μm.

In the piston according to the invention (5), the resinous coating layer formed on the skirt part surface is made in the range of 5 μm to 30 μm in the film thickness.

When the resinous coating layer according to this invention is 5 μm or thinner in the film thickness, concaves surrounded by the resinous coating layer are shallow in depth and the oil retention volume and capability of concaves become small resulting in difficulty to form the oil film on the surface of resinous coating layer and be effective in reducing friction in the complex lubrication region.

On the other hand, when the film thickness of the resinous coating layer according to this invention is 30 μm or thicker, concaves surrounded by the resinous coating layer become deep to the bottom such that a large amount of oil is required in the concaves resulting in difficulty to be effective in reducing friction under the sliding environment of the skirt part in not a very good oil lubrication state.

(6) The piston according to any one of (3) through (5) in which when a shortest interval between said adjacent concaves in said circumferential direction is "PL," said "PL" is in a range from "0.5"×"S" to "2"×"S."

In the piston according to the invention (6), when the shortest interval between adjacent concaves in the circumferential direction perpendicular to the skirt part sliding direction is "PL," this "PL" is set up in the range from "0.5"×"S"to "2"×"S."

When the shortest film interval PL between adjacent concaves in the circumferential direction is "0.5"×"S" or less, the strength of the resinous coating layer which will become the coating wall is insufficient such that the resinous coating layer is predicted to be destroyed by the shearing force added thereto. On the other hand, when the above-described shortest film interval PL is "2"×"S" or more, probability of solid contact becomes high such that the reduction of frictional resistance of the skirt part as a whole is not promoted.

(7) The piston according to any one of (3) through (5) in which when a shortest interval between said adjacent concaves in said sliding direction is "PS," said "PS" is in a range from "0.5"×"S" to "2"×"S."

In the piston according to the invention (7), when the shortest interval between adjacent concaves in the aforementioned sliding direction of the skirt part is "PS," this "PS" is set up in the range from "0.5"×"S" to "2"×"S."

When the shortest film interval PS between adjacent concaves in the sliding direction is "0.5"×"S" or less, the strength of the resinous coating layer which will become the coating wall is insufficient such that the resinous coating layer is predicted to be destroyed by the shearing force added thereto. On the other hand, when the above-described shortest film interval PS is "2"×"S" or more, probability of solid contact becomes high such that the reduction of frictional resistance of the skirt part as a whole is not promoted.

Any one of (1) through (7) in which the aforementioned resin is at least one type selected from a group comprising polyamide resin, polyphenylene sulfide, epoxy resin, phenol resin, silicone resin, polyamide-imide resin, polyimide resin and polytetrafluoroethylene resin.

In the piston according to the invention (8), the resin is at least one type selected from a group comprising polyamide resin (PA), polyphenylene sulfide (PPS), epoxy resin, phenol resin, silicone resin, polyamide-imide resin (PAI), polyimide resin (PI) and polytetrafluoroethylene resin (PTFE). These resins have the low frictional resistance and high thermostability properties.

(9) The piston according to any one of (1) through (8) in which the above-described resinous coating layer contains at least one type of inorganic solid lubricant selected from a group comprising transition metal sulfides, graphite, hexagonal boron nitride, synthetic mica and talc.

In the piston according to the invention (9), the resinous coating layer contains at least one type of inorganic solid lubricant selected from a group comprising transition metal sulfides, graphite, hexagonal boron nitride, synthetic mica and talc. Transition metal sulfides can be exemplified by molybdenum disulfide ($MoS_2$) or tungsten disulfide ($WS_2$).

(10) The piston according to any one of (1) through (9) in which the aforementioned resinous coating layer contains an organic solid lubricant comprising fluorocarbon resins.

In the piston according to the invention (10), the resinous coating layer contains an organic solid lubricant comprising fluorocarbon resins. The organic solid lubricants comprising fluorocarbon resins can be exemplified by polytetrafluoroethylene (PTFE) and tetrafluoroethylene-perfluoroalkylvinylether (PFA).

The piston of this invention is a piston to be used in the internal combustion engine, on the skirt part surface of which a resinous coating layer is formed. In the resinous coating layer, a plurality of regularly arranged concaves are provided such that the frictional resistance can be reduced in both of the solid contact region in a poor lubrication state and the oil-circulating complex lubrication region.

Further, the piston of this invention is able to reduce the frictional resistance in the complex lubrication region only by a chemical coating treatment without applying a conventional mechanical surface treatment to the skirt part, such that the frictional resistance can be reduced of the skirt part as a whole.

DETAILED DESCRIPTION OF THE INVENTION

In the following, the best mode for carrying out the present invention will be explained with reference to the drawings.

Figure 1:
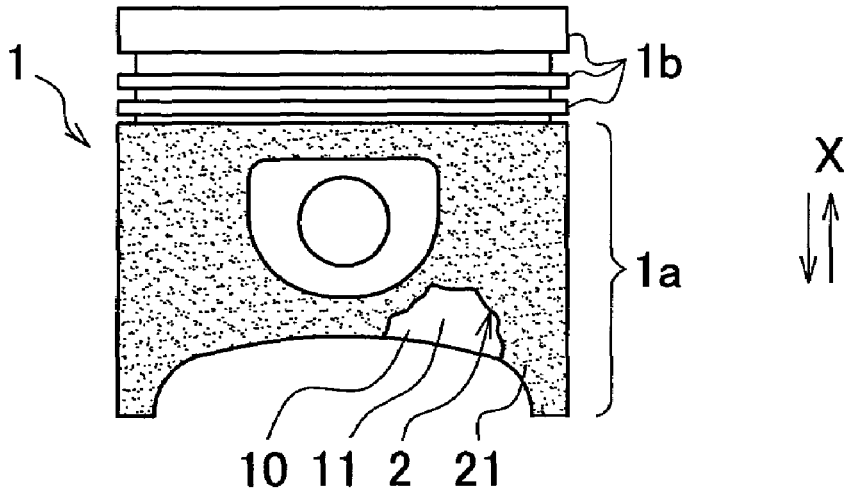
FIG. 1 is a front view showing one embodiment of a piston according to the present invention, depicting a partially sectioned coating layer.
Figure 2:
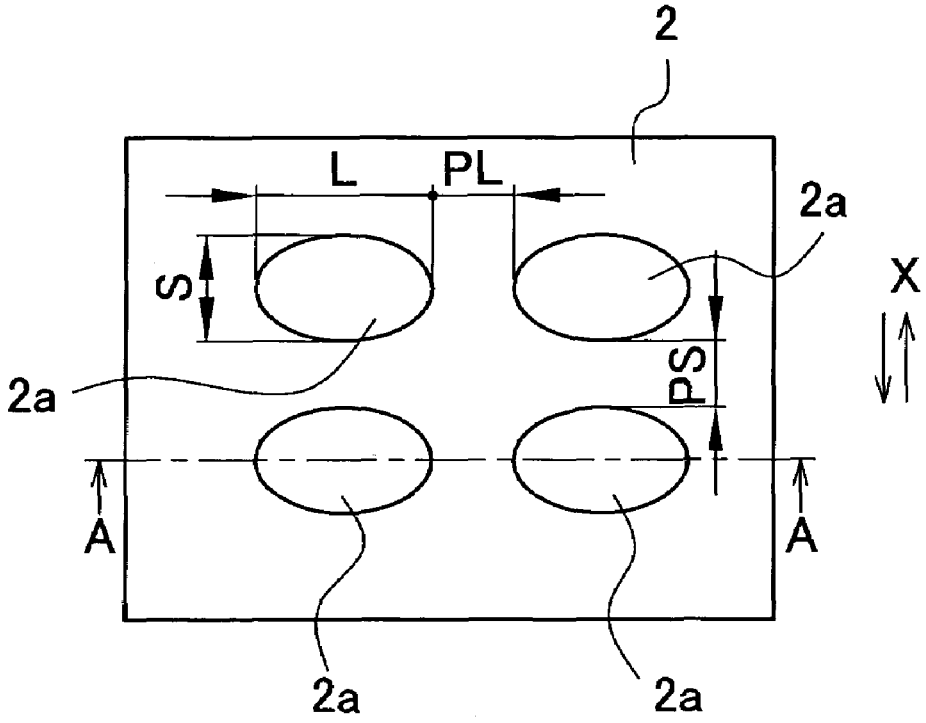
FIG. 2 is a partial enlarged view of the skirt part surface according to the embodiment of the present invention.
Figure 3:
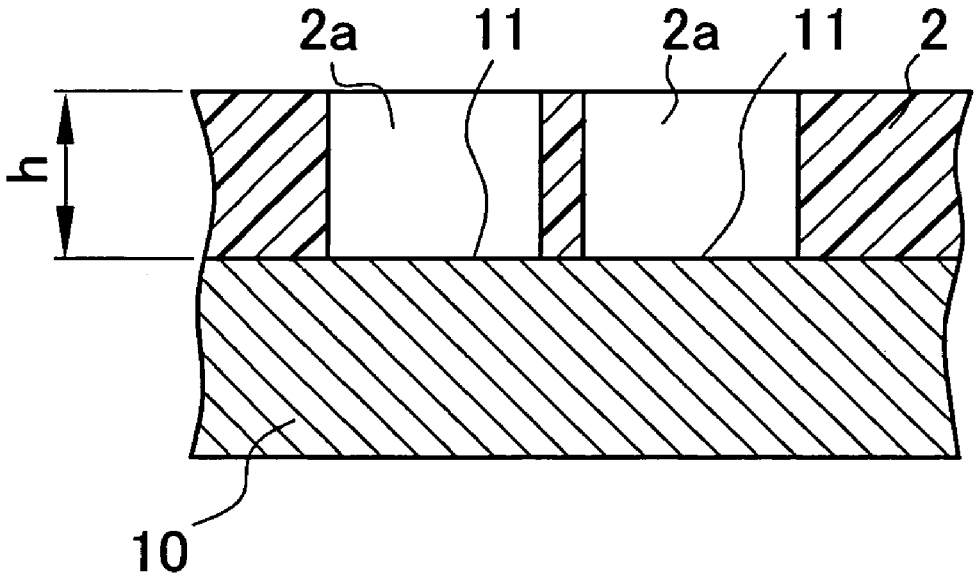
FIG. 3 is a partial sectional view of the skirt part according to the embodiment of the present invention.
Figure 4:
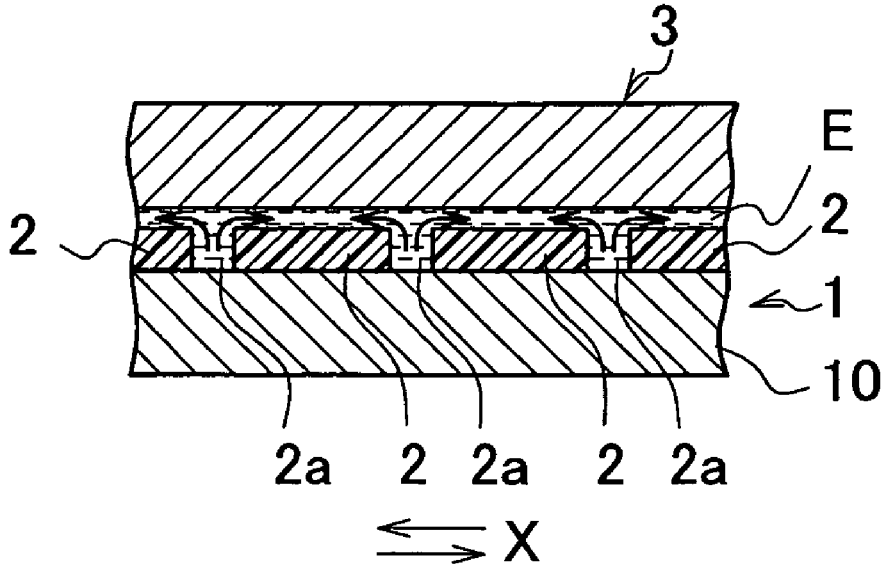
FIG. 4 is a longitudinal sectional view of a relevant part of the skirt part and sleeve part according to the embodiment of the present invention.

FIG. 1 is a front view showing one embodiment of a piston according to this invention. FIG. 1 depicts a partially sectioned coating layer. FIG. 2 is a partial enlarged view of the skirt part surface according to the above-described embodiment. FIG. 3 is a partial sectional view of the skirt part surface according to the above-described embodiment. FIG. 3 is a sectional view along the arrow line A-A of FIG. 2. FIG. 4 is a longitudinal sectional view of a relevant part of the skirt part and sleeve according to the above-described embodiment.

Figure 5A:
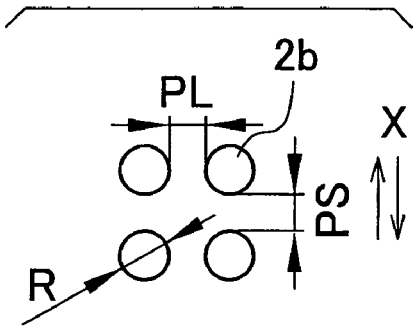
FIG. 5A and FIG. 5B are plan views of the arrangement of a number of concaves according to the embodiment of the present invention.
Figure 5B:
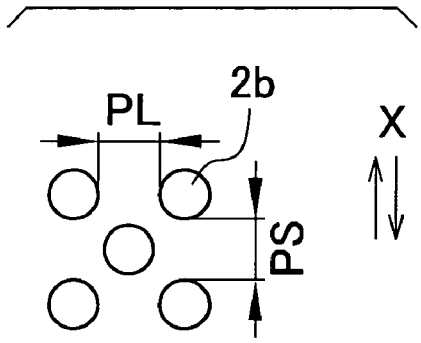
Figure 6A:
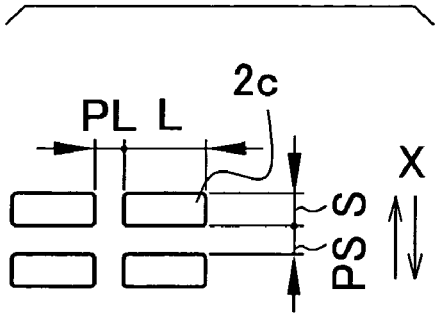
FIG. 6A and FIG. 6B are plan views of the arrangement of a number of concaves according to the embodiment of the present invention.
Figure 6B:
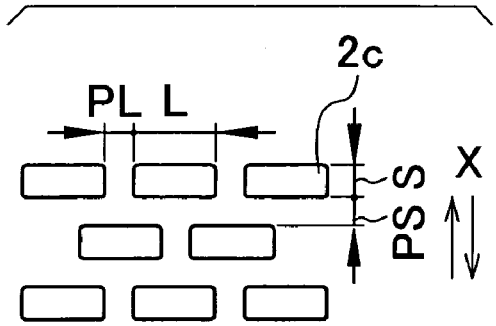
Figure 7A:
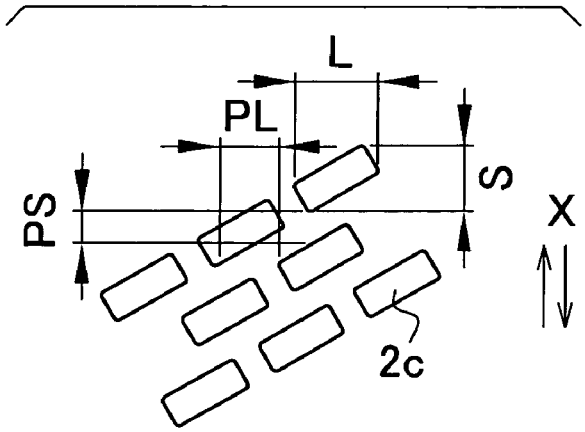
FIG. 7A and FIG. 7B are plan views of the arrangement of a number of concaves according to the embodiment of the present invention.
Figure 7B:
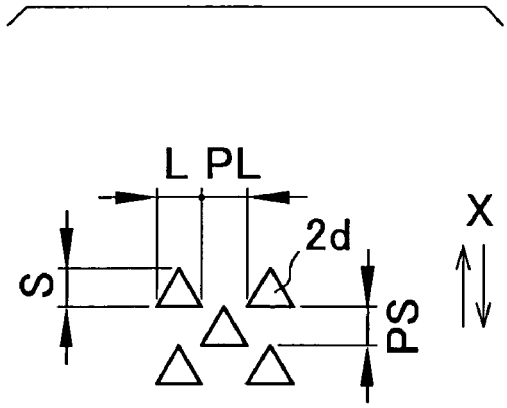

FIG. 5 is a plan view of the arrangement of a number of concaves according to the above-described embodiment. FIG. 5A depicts one arrangement example of circular concaves, and FIG. 5B shows a different arrangement example of circular concaves from FIG. 5A. FIG. 6 is a plan view of the arrangement of a number of concaves according to the above-described embodiment. FIG. 6A depicts one arrangement example of rectangular concaves, and FIG. 6B shows a different arrangement example of rectangular concaves from FIG. 6A. FIG. 7 is a plan view of the arrangement of a number of concaves according to the above-described embodiment. FIG. 7A shows a different arrangement example of rectangular concaves from FIG. 6A. FIG. 7B is one arrangement example of equilateral triangular concaves.

Figure 8:
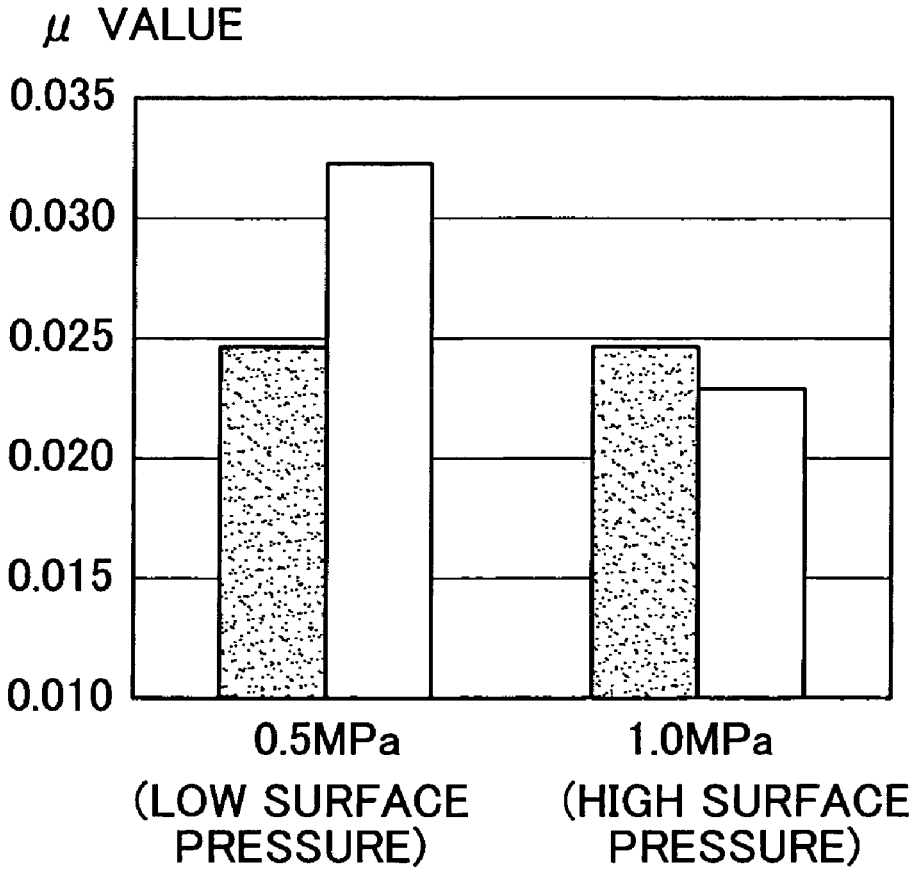
FIG. 8 is a graph comparing the frictional coefficient μ values of the conventional skirt part and the skirt part according to the embodiment of the present invention.
Figure 9:
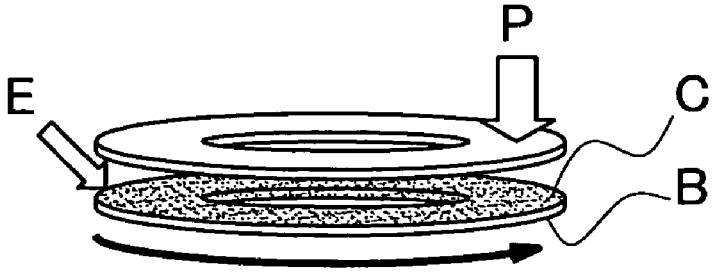
FIG. 9 is a schematic diagram of the constitution of a tester for measuring the frictional coefficient μ values of the skirt part according to the embodiment of the present invention.

FIG. 8 is a graph comparing the frictional coefficient μ values of the conventional skirt part and the skirt part according to this invention. FIG. 9 is a schematic diagram of the constitution of a tester for measuring the frictional coefficient μ values of the skirt part according to this invention.

Firstly, the constitution of a piston of internal combustion engine according to this invention will be explained. In FIG. 1, the piston 1 is usually supported with three pieces of piston rings (not shown) to perform the reciprocating motion within the cylinder. The piston body 10 made of aluminum alloy is cylindrically formed, consisting of a skirt part 1*a* and a land part 1*b*. The land part 1*b* has a piston-top surface to retain the piston rings. Further, of the piston body 10, the outer circumferential surface 11 of the skirt part 1*a* is a part having the largest area making contact with the sleeve 3 (cf. FIG. 4) while sliding.

Therefore, the surface 21 of the skirt part 1*a* may be a surface covering the outer circumferential surface 11 of the skirt part 1*a*, and a part making contact with the cylinder inner wall while sliding. Herein, the arrow X in the figure indicates the sliding direction of the skirt part 1*a*.

As shown in FIG. 1, a resinous coating layer 2 is formed on the surface of the skirt part 1*a*. The surface of the skirt part 1*a* is substantially flat and smooth, and a number of concaves surrounded by the resinous coating layer 2 are regularly arranged thereon.

In FIG. 1, the resinous coating layer 2 may be formed over the entire region of the outer circumferential surface 11 of the skirt part 1*a*, or on the outer circumferential surface 11 of the skirt part 1*a* except for the periphery of the pin opening for inserting the pin for connecting the cylinder and connecting rod. This is because usually the periphery of the pin opening becomes a side wall formed by cutting off the outer circumferential surface 11 of the skirt part 1*a*. As the occasion may demand, the area range and position of the resinous coating layer 2 may be limited.

Thus, in the piston 1, the surface 21 of the skirt part 1*a* is substantially flat and smooth such that a resinous coating layer made of a single resin having a low frictional resistance and a high thermostability may be formed on the surface 21 of the skirt part 1*a*, and a resinous coating layer made of a composite resin containing a solid lubricant in the aforementioned single synthetic resin may be formed on the surface 21 of the skirt part 1*a*. Thus, the frictional resistance of solid contact region of the skirt part can be reduced. In this case, the single resin or the composite resin may be appropriately selected.

In the piston 1 according to this invention, a number of concaves (e.g. cf. elliptic concaves 2*a* in FIG. 2) surrounded by the resinous coating layer 2 are arranged in regularity on the coating layer 2. Concaves 2*a* can be regarded, for example, as the part expressed as a predetermined area on the surface 21 of the skirt part 1*a*, and actually surrounded by the resinous coating layer 2 to have a predetermined volume (cf. FIG. 3).

And, the shape of concaves surrounded by the resinous coating layer 2 and expressed on the surface 21 thereof may be, for example, circle (circular concaves 2*b*) as shown in FIG. 5, or ellipse (elliptic concaves 2*a*) as shown in FIG. 2. Further, the shape of concaves may be square, rectangular (rectangular concaves 2*c*) as shown in FIGS. 6 and 7, triangular (triangular concaves 2*d*) as shown in FIG. 7B, and also any other shapes comprising the closed region.

FIG. 2 and FIGS. 5 to 7 exemplify proper arrangements of concaves 2*a* to 2*d*. For example, in FIG. 2, elliptic concaves 2*a* are arranged in a rectangular lattice. And in FIG. 5A, circular concaves 2*b* are arranged in a rectangular lattice. In FIG. 5B, circular concaves 2*b* are arranged in a rhombic lattice, that is, at four corners of a rectangular shape and at an inter-section of diagonal lines connecting the corners. In FIG. 6A, rectangular concaves 2*c* are arranged in a rectangular lattice. In FIG. 6B, rectangular concaves 2*c* are arranged in a rhombic lattice, that is, at four corners of a rectangular shape and at an inter-section of diagonal lines connecting the corners.

In FIG. 7A, rectangular concaves 2*c* are arranged in a manner along the rhombic lattice. In FIG. 7B, triangular concaves 2*d* are arranged in a rhombic lattice. Further, circular or rectangular concaves may be arranged in equal intervals in the sliding direction X of the skirt part 1*a* and the circumferential direction perpendicular to the sliding direction X respectively, or in intervals different in the sliding direction of the skirt part 1*a* and the above-described circumferential direction.

As shown in FIG. 4, for example, the concaves 2*a* have a certain volume to be conferred with the oil-retaining function. A plurality of concaves can function as what is called oil reservoir. These concaves 2*a* as the oil reservoir can reduce the frictional resistance of the complex lubrication region of the skirt part 1*a*. Further, the present invention can reduce the frictional resistance of the complex lubrication region only by a chemical coating treatment without applying the mechanical surface treatment to the skirt part as usual. Thus the frictional resistance can be reduced at the skirt part as a whole.

Further, the inventors have actively pursued the experiment, and, as a result, found out that there are several conditions in the concave size, intervals between adjacent concaves, coating film thickness and such for making this invention effective. The first condition is to set up the relationship of "S"="L" or "S"<"L" when the length of the concaves in the sliding direction of the skirt part is "S" and the length in the circumferential direction perpendicular to the sliding direction is "L."

The inventors have confirmed it effective to set up concaves of this invention in relationship of "S"="L" or "S"<"L." When the concaves are set up in relationship of "S">"L," sufficient oil pressure becomes difficult to be secured in the concaves while the skirt part is sliding such that the oil film is hardly formed on the surface 21 (sliding surface) thereof (cf. FIG. 4) and becomes difficult to be effective in reducing the friction in the complex lubrication region.

For example, the shape of concaves set up in relationship of "S"="L" is circle (cf. FIG. 5) or square. When the shape of concaves in relationship of "S"<"L" is elliptic (cf. FIG. 2), by arranging the major axis of ellipse parallel to the outer circumferential direction of the skirt part 1*a*, and the minor axis of ellipse perpendicular to the aforementioned major axis parallel to the sliding direction of the skirt part 1*a*, the oil pressure can be secured in concaves and become effective in reducing the friction in the complex lubrication region of the skirt part.

The second condition is to set up the length of the concaves "S" in the sliding direction of the skirt part 1*a* and the length of the concaves "L" in the circumferential direction of the skirt part 1*a* in the range of 5 μm to 4 mm.

For example, when the shape of concaves is circle (cf. FIG. 5) and the diameter of the circular concaves 2*b* is not more than 5 μm, the oil E due to its own viscosity becomes difficult to flow into these minute concaves such that the oil retention function at the concaves is lowered. Accordingly, the friction-reducing effect of oil becomes difficult to be displayed in the complex lubrication region. On the other hand, when the diameter of non-coated circular concaves 2*b* is not less than 4 mm, the oil E (cf. FIG. 4) retained in the concaves 2*b* flows out by surface pressure such that the oil film becomes difficult to be formed on the coating layer. Accordingly, the friction-reducing effect of oil becomes difficult to be displayed in the complex lubrication region.

The third condition is to form the resinous coating layer 2 having the film thickness h in the range of 5 μm to 30 μm (cf. FIG. 3). When the film thickness h of the resinous coating layer 2 is 5 μm or less, for example, the depth of the formed concaves 2*a* (cf. FIG. 3) is shallow, so that the oil retention amount and capability at the concaves 2*a* become small and the oil film becomes difficult to be formed on the surface of the resinous coating layer 2. Therefore, the friction-reducing effect of oil is hardly displayed in the complex lubrication region.

On the other hand, when the film thickness h of the resinous coating layer 2 is 30 μm or more (cf. FIG. 3), for example, the depth of the formed concaves 2*a* (cf. FIG. 3) is deep and a large amount of oil is required in concaves 2*a* such that the friction-reducing effect of oil is hardly displayed in the sliding environment of the skirt part 1*a* in not a very good lubrication state of the oil E.

The fourth condition is, when the shortest film interval between adjacent concaves in the circumferential direction perpendicular to the sliding direction X is "PL," to set up PL in the range of 0.5×S to 2×S (cf. FIG. 2). When the shortest film interval PL is 0.5×S or less, strength of the resinous coating layer 2 which will become the coating wall becomes insufficient such that the resinous coating layer 2 is predicted to be destroyed by the shearing force added thereto. On the other hand, when the shortest film interval PL is 2×S or more, probability of solid contact becomes high so that the reduction of frictional resistance of the skirt part as a whole is not promoted.

The fifth condition is, when the shortest film interval between adjacent concaves in the sliding direction X of the skirt part 1*a* is "PS," to set up PS in the range of 0.5×S to 2×S (cf. FIG. 2). When the shortest film interval PS is 0.5×S or less, strength of the resinous coating layer 2 which will become the coating wall becomes insufficient so that the resinous coating layer 2 is predicted to be destroyed by the shearing force added thereto. On the other hand, when the shortest film interval PS is 2×S or more, probability of solid contact becomes high so that the reduction of frictional resistance of the skirt part as a whole is not promoted.

Resins which will become the matrix of coating layer applied to the present invention can be exemplified by polyamide resin (PA), polyphenylene sulfide (PPS), epoxy resin, phenol resin, silicone resin, polyamide-imide resin (PAI), polyimide resin (PI) and polytetrafluoroethylene resin (PTFE). These resins are preferable in particular because they have the low frictional resistance and high thermostability. They may be composite resins comprising two types or more resins selected from the aforementioned resins. Herein, "composite resins" refer to those prepared by techniques including the resin blending, polymer alloy formation, copolymerization and such.

Further, the above-described coating layer may contain, besides the aforementioned resins, an inorganic solid lubricant. As examples of inorganic solid lubricant, fillers such as transition metal sulfides including molybdenum disulfide ($MoS_2$) and tungsten disulfide ($WS_2$), graphite, hexagonal boron nitride, synthetic mica and talc are cited. They may be used singly or in combination of two types or more thereof.

The above-described coating layer may contain, besides the aforementioned resins, an organic solid lubricant. Examples of organic solid lubricant are fillers comprising fluorocarbon resins such as polytetrafluoroethylene (PTFE) and tetrafluoroethylene-perfluoroalkylvinylether (PFA). They may be used singly or in combination of two types or more thereof.

Among them, coating layer prepared by combining $MoS_2$ and PTFE with PAI as the basic material is preferable in particular because it has a low frictional resistance and a high thermostability.

EXAMPLES

In the following, the present invention will be explained with reference to examples. As a tester measuring the frictional coefficient value μ of the coating layer according to this invention, a low velocity friction apparatus (LVFA) prescribed by "JASO M349-95" was used. As shown in the schematic diagram of LVFA constitution in FIG. 9, several types of the coating film C shown in Table 1 below were formed on the test piece B made of aluminum alloy.

While the test piece B coated with these coating films C was rotated at a peripheral velocity of 6 m/sec, the engine oil E was continuously added in drops unto the coating film C which was pressed with a plate under a predetermined surface pressure P to measure the frictional coefficient μ value. The results are shown in table 1. Pattern specification in Table 1 indicates shape and size of concaves as well as intervals between adjacent concaves, etc.

TABLE 1

| | | Example | | | | | | | | |
|---|---|---|---|---|---|---|---|---|---|---|
| | | 1 | 2 | 3 | 4 | 5 | 6 | 7 | 8 | 9 |
| Material | | Polyamide-imide composite coating film PAI = 40% $MoS_2$ = 30% PTFE = 30% | Same as on the left | Same as on the left | Same as on the left | Phenol resin monomer | Same as on the left | Polyamide-imide composite coating film PAI = 40% $MoS_2$ = 30% PTFE = 30% | Same as on the left | Phenol resin monomer |
| Film thickness (μm) | | 10 | 10 | 10 | 10 | 10 | 10 | 3 | 10 | 10 |
| Pattern specification | Type | Circular | Same as on the left | Square | Same as on the left | Circular | Square | Circular | None | None |
| | L(mm) | 2 | 5 | 2 | 5 | 2 | 2 | 2 | — | — |
| | S(mm) | 2 | 5 | 2 | 5 | 2 | 2 | 2 | — | — |
| | L/S | 1 | 1 | 1 | 1 | 1 | 1 | 1 | — | — |
| | PL(mm) | 2 | 5 | 2 | 5 | 2 | 2 | 2 | — | — |
| | PS(mm) | 2 | 5 | 2 | 5 | 2 | 2 | 2 | — | — |
| μ value | | 0.025 | 0.032 | 0.026 | 0.035 | 0.03 | 0.032 | 0.034 | 0.035 | 0.04 |
| Note | | | | | | | | | No pattern | No pattern |

In examples 1 to 4, 7 and 8 of Table 1, a polyamide-imide composite resin comprising PAI (40%), $MoS_2$ (30%) and PTFE (30%) was used. And, in examples 5, 6 and 9 of Table 1, a single resin comprising phenol resin was used.

Results shown in Table 1 supported the conditions set up as described above. For example, comparison of examples 1 and 2 and that of examples 3 and 4 support the reason why the lengths of the concaves "L" and "S" are set up in the range of 5 μm to 4 mm.

In addition, FIG. 8 represents a graph showing the results of μ value measurements in which the surface pressure P is varied from "0.5" MPa to "1.0" MPa in Example 1 of Table 1 and a conventional product with no coating film C provided on the test piece B shown in FIG. 9. In FIG. 8, the left bar with pattern represents the result of Example 1 and the right white bar shows the result of the conventional product.

As shown in FIG. 8, it is proved that the piston skirt of this invention shows a lower μ value compared to the conventional product even under a low surface pressure around "0.5" MPa, and also does not alter its μ value even under such a high surface pressure as about "1.0" MPa.

Since the sliding environment of piston is accompanied with the low to high surface pressure fluctuation, μ values are preferably low under not only a specific surface pressure but also a wide range of surface pressure conditions. In the piston skirt of this invention, not only the μ value is reduced under the low surface pressure but also this low μ value is maintained under the wide range of surface pressure conditions. Therefore, engine using the piston skirt of this invention can improve the fuel efficiency.

What is claimed is:

1. A piston for an internal combustion engine, the piston having a skirt part, comprising:

a resinous coating layer formed on a surface of the skirt part; and at least four concaves having a common geometric shape which are regularly arranged in the form of one of rhombic and rectangular lattices in the resinous coating layer, wherein a length of said concaves in a sliding direction of said skirt part is "S" and a length of said concaves in a circumferential direction perpendicular to said sliding direction is "L" the length being in relationship of "S"="L" or "S"<"L," and wherein said "S" and "L" are not less than 5 μm and not more than 4 mm.

2. The piston according to claim 1, wherein said concaves are non-coated regions in which said resinous coating layer is not formed.

3. The piston according to claim 1, wherein when a shortest interval between said adjacent concaves in said circumferential direction is "PL," said "PL" is in a range from "0.5"×"S" to "2"×"S".

4. The piston according to claim 1, wherein when a shortest interval between said adjacent concaves in said sliding direction is "PS " said "PS" is in a range from "0.5"×"S" to "2"×"S".

5. The piston according to claim 1, wherein a depth of said concaves is not less than 5 μm and not more than 30 μm.

6. The piston according to claim 1, wherein said resin is at least one type selected from a group comprising polyamide resin, polyphenylene sulfide, epoxy resin phenol resin, silicone resin, polyamide-imide resin, polyimide resin and polytetrafluoroethylene resin.

7. The piston according to claim 1, wherein said resinous coating layer contains at least one type of inorganic solid lubricant selected from a group comprising transition metal sulfides, graphite, hexagonal boron nitride, synthetic mica and talc.

8. The piston according to claim 1, wherein said resinous coating layer contains an organic solid lubricant comprising fluorocarbon resin.

9. The piston according to claim 1, wherein the length "L" decreases as the length "L" moves in a direction of the top dead center of the piston.

10. A piston for an internal combustion engine, the piston having a skirt part, comprising:

a resinous coating layer formed on a surface of the skirt part; and a plurality of concaves regularly arranged in the resinous coating layer, wherein when a length of said concaves in a sliding direction of said skirt part is "S," and a length of said concaves in circumferential direction perpendicular to said sliding direction is "L," the lengths are set in relationship of "S"="L" or "S"<"L", and wherein a shortest interval between said adjacent concaves in said circumferential direction is "PL," said "PL" being in a range from "0.5"×"S" to "2"×"S".

11. The piston according to claim 10, wherein said concaves are non-coated regions in which said resinous coating layer is not formed.

12. The piston according to claim 10, wherein a depth of said concaves is not less than 5 μm and not more than 30 μm.

13. The piston according to claim 10, wherein said resin is at least one type selected from a group comprising polyamide resin, polyphenylene sulfide, epoxy resin, phenol resin, silicone resin, polyamide-imide resin, polyimide resin and polytetrafluoroethylene resin.

14. The piston according to claim 10, wherein said resinous coating layer contains at least one type of inorganic solid lubricant selected from a group comprising transition metal sulfides, graphite, hexagonal boron nitride, synthetic mica and talc.

15. The piston according to claim 10, wherein said resinous coating layer contains an organic solid lubricant comprising fluorocarbon resin.

16. A piston for an internal combustion engine, the piston having a skirt part, comprising:

a resinous coating layer formed on a surface of the skirt part; and at least four concaves having a common geometric shape which are regularly arranged in the form of one of rhombic and rectangular lattices in the resinous coating layer, wherein when a length of said concaves in a sliding direction of said skirt part is "S," and a length of said concaves in circumferential direction perpendicular to said sliding direction is "L," the lengths are set in relationship of "S"="L" or "S"<"L", and wherein a shortest interval between said adjacent concaves in said circumferential direction is "PS," said "PS" being in a range from "0.5"×"S" to "2"×"S".

17. The piston according to claim 16, wherein said concaves are non-coated regions in which said resinous coating layer is not formed.

18. The piston according to claim 16, wherein a depth of said concaves is not less than 30 μm.

19. The piston according to claim 16, wherein said resin is at least one type selected from a group comprising polyamide resin, polyphenylene sulfide, epoxy resin, phenol resin, silicone resin, polyamide-imide resin, polyimide resin and polytetrafluoroethylene resin.

20. The piston according to claim 16, wherein said resinous coating layer contains at least one type of inorganic solid lubricant selected from a group comprising transition metal sulfides, graphite, hexagonal boron nitride, synthetic mica and talc.

21. The piston according to claim 16, wherein said resinous coating layer contains an organic solid lubricant comprising fluorocarbon resin.

22. The piston according to claim 16, wherein the length "L" decreases as the length "L" moves in a direction of the top dead center of the piston.

* * * * *